US010751911B2

(12) United States Patent
Toncelli

(10) Patent No.: US 10,751,911 B2
(45) Date of Patent: Aug. 25, 2020

(54) PROGRAMMABLE STATION AND PLANT FOR THE PRODUCTION OF PLATES WITH CHROMATIC EFFECTS

(71) Applicant: Luca Toncelli, Bassano del Grappa (IT)

(72) Inventor: Luca Toncelli, Bassano del Grappa (IT)

( * ) Notice: Subject to any disclaimer, the term of this patent is extended or adjusted under 35 U.S.C. 154(b) by 306 days.

(21) Appl. No.: 15/538,868

(22) PCT Filed: Jan. 8, 2016

(86) PCT No.: PCT/IB2016/050084
§ 371 (c)(1),
(2) Date: Jun. 22, 2017

(87) PCT Pub. No.: WO2016/113652
PCT Pub. Date: Jul. 21, 2016

(65) Prior Publication Data

US 2017/0355101 A1 Dec. 14, 2017

(30) Foreign Application Priority Data

Jan. 13, 2015 (IT) ..... TV2015A0004

(51) Int. Cl.
*B28B 1/02* (2006.01)
*B28B 13/02* (2006.01)
*B28B 1/00* (2006.01)

(52) U.S. Cl.
CPC ..... *B28B 13/0295* (2013.01); *B28B 1/005* (2013.01); *B28B 13/0205* (2013.01); *B28B 13/021* (2013.01); *B28B 13/028* (2013.01); *B28B 13/0285* (2013.01)

(58) Field of Classification Search
CPC ..... B28B 1/005
See application file for complete search history.

(56) References Cited

U.S. PATENT DOCUMENTS 5,429,676 A 7/1995 Uchida et al.

FOREIGN PATENT DOCUMENTS

EP 1767320 A1 3/2007
WO 2005090034 A1 9/2005

OTHER PUBLICATIONS

PCT International Search Report and Written Opinion dated Apr. 11, 2016 for Intl. App. No. PCT/IB2016/050084, from which the instant application is based, 11 pgs.

*Primary Examiner* — Ryan M Ochylski
(74) *Attorney, Agent, or Firm* — Fredrikson & Byron, P.A.

(57) ABSTRACT

Station for the realization of coloring effects in a mix for the production of slabs, includes: —a working surface intended to accommodate a temporary support with a basic mix layer for the formation of a slab; —at least one dye dispensing device for emitting dyes towards the working surface so as to deposit them on the basic mix layer on the temporary support accommodated on the working surface; —movement means for the relative movement of the dispensing device above the working surface; —a control system connected to the movement means for controlling the displacement of the dispensing device so as to follow trajectories along which dyes are emitted towards the mix layer; —at least one tool movable with the movement means (18, 118) and intended to interact mechanically with areas of the mix layer for receipt of the dyes emitted by the dispensing device to achieve coloring effects in the mix.

17 Claims, 9 Drawing Sheets

PROGRAMMABLE STATION AND PLANT FOR THE PRODUCTION OF PLATES WITH CHROMATIC EFFECTS

RELATED APPLICATIONS

This application is a 35 U.S.C. 371 national stage filing from International Application No. PCT/IB2016/050084, filed Jan. 8, 2016, which claims priority to Italian Application No. TV2015A000004, filed Jan. 13, 2015, the teachings of which are incorporated herein by reference.

The present invention relates to a programmable station for the production of slabs with coloring effects such as a veined effect. In particular, the slabs may for example consist of artificial agglomerate or ceramic material.

The invention also relates to a coloring plant and method.

The slabs mentioned here are usually made by means of preparation of one or more starting mixes comprising basic granular materials (for example stone and/or stone-like or ceramic material) and a binder, such as a cement or suitable hardening synthetic resin or other organic and/or inorganic binder.

For production of veining or similar effects, in the prior art it has been proposed depositing a dye onto the surface of the mix already arranged on a support or mold for forming the slab. By means of this method, however, it is possible to obtain only highly random or only superficial veining effects.

In order to improve the result at present a preferred method is to use weighing feeders provided with dye dispensers. The weighing feeder essentially consists of a hopper inside which a mix is poured, while underneath an extractor belt is arranged so that the mix may flow out and be poured and distributed over the support or mould as a result of the mix falling at the end of said belt.

In order to produce veined effects, dispensers of coloring agents are positioned above the extractor belt so as to distribute one or more dyes on top of the mix passing towards the falling zone and therefore before it is poured onto the support or inside the mold.

In this way it is possible to obtain a veined effect which extends over at least a certain distance within the thickness of the slab, in particular in the case where vibrocompression or vibrocompaction of the material inside the mold is subsequently performed.

The system described above, although efficient, still has however a number of drawbacks.

In fact, the distribution of the dye is still for example entirely random so that the veined effect created is also random and non-controllable.

Consequently, it has not been possible for example to obtain veined slabs with a specific design of the veining.

Moreover, with this system only short and thin veins are formed as a result of the "stripping" effect due to the falling movement of the mix onto the belt.

It is therefore not possible to obtain for example a so-called stained coloring effect where there are bigger or smaller zones or areas which have tones or shades different from the rest of the slab, or obtain relatively long veins, for example with a length ranging from a few decimeters to several meters.

The coloring effects are moreover substantially monodirectional and extend in the direction of travel of the belt.

Moreover, in the known systems changing the color is a long and difficult process, also resulting in long downtimes of the plant. It is therefore not possible, for example, to vary the colors on the same slab or even only from one slab to another.

The general object of the present invention is to manage to overcome the drawbacks of the prior art and produce slabs having coloring effects such as veining which advantageously can be predefined substantially as required and in a reproducible manner with a satisfactory degree of precision.

Another object is that of managing to obtain slabs in which a "stained" effect may be obtained where some zones or areas of the slab, which are bigger or smaller in size, have particular shades of color.

Another object is that of being able to obtain relatively long veins which may also extend, for example, from a few decimeters to a several meters along the slab.

Another object is to obtain slabs in which the veining or the coloring effect involves practically the whole thickness of the slab so as to be able to use the slabs also in applications where this characteristic feature is of fundamental importance or in any case desirable, such as for example in kitchen worktops or in bathroom surfaces with decorated edges or in tables.

A further object is that of making the management of different dyes easier and faster so as to be able to pass from one dye to another in a simple and rapid manner.

In view of these objects the idea which has occurred is to provide, according to the invention, a station for the realization of coloring effects in a mix for the production of slabs, comprising: a working surface intended to accommodate a temporary support with a basic mix layer for the formation of a slab; at least one dye dispensing device for emitting dyes towards the working surface so as to deposit them on the basic mix layer on the temporary support accommodated on the working surface; movement means for the relative movement of the dispensing device above the working surface; a control system connected to the movement means for controlling the displacement of the dispensing device on the working surface so as to follow trajectories along which dyes are emitted towards the mix layer; at least one tool movable with the movement of the movement means and intended to interact mechanically with areas of the mix layer on the temporary support accommodated on the working surface which receive or are intended to receive the dyes emitted by the dispensing device to achieve coloring effects in the mix.

Still according to the invention the idea has also occurred to provide a method for the realization of coloring effects on a slab by means of the coloring station, which comprises the steps of: supporting on the working surface a temporary support with a basic mix layer for the formation of the slab; under the control of the electronic control system, causing the dispensing device to follow coloring trajectories so that it emits dyes towards the coloring surface and deposits them in the basic mix layer; moving the mix layer to a subsequent hardening step; the method also comprises the step that, while the dispensing device follows coloring trajectories, the areas of mix which are receive or are intended to receive the dyes are subject to the mechanical action of a tool present on the dispensing device.

Still according to the invention, the idea has occurred to provide a plant for the production of slabs, comprising a conveying line along which the following stations are arranged sequentially: a station for the realization of coloring effects of the abovementioned type, a station for vibrocompression or vibrocompaction of the mix with the coloring effects, and a station for hardening of the mix with the coloring effects.

In order to illustrate more clearly the innovative principles of the present invention and its advantages compared to the prior art, an example of embodiment applying these principles will be described below with the aid of the accompanying drawings. In the drawings.

Figure 1:
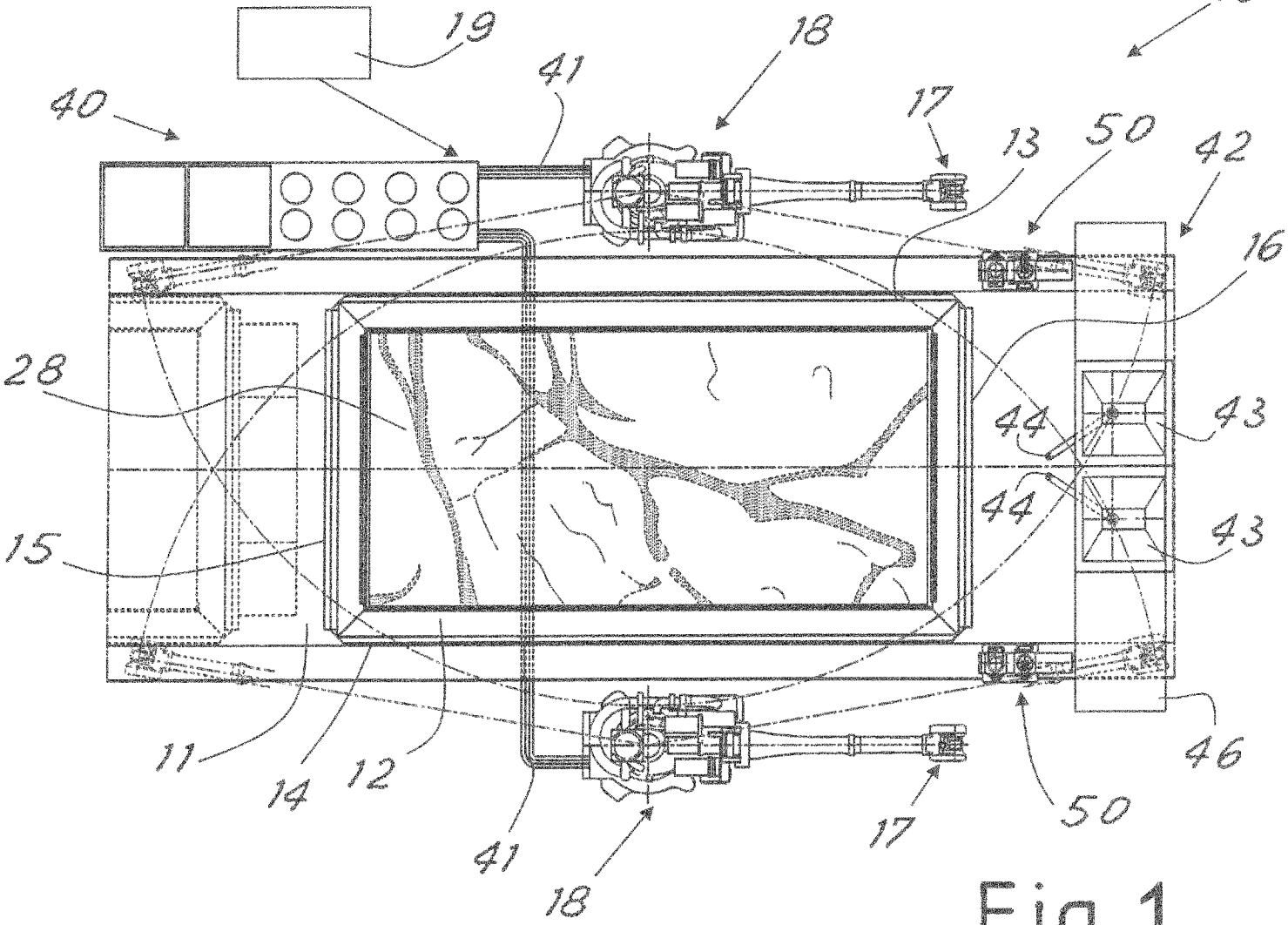
FIG. 1 shows a schematic view from above of a first embodiment of a station according to the principles of the invention.

With reference to the figures, FIG. 1 shows a station, denoted overall by 10, applying the principles of the invention.

As will become clear below, the station 10 is a programmable robotic machine for the generation of coloring effects, in particular veined effects, in the mass of the mix for formation of a slab consisting, for example, of an artificial agglomerate or ceramic material.

Advantageously, the coloring effects are obtained by means of dispensing of dye in powder and/or liquid form, mechanical interaction and subsequent reaggregation of the mix.

The station can be advantageously used to provide a plant for the production of slabs of artificial agglomerate or ceramic material, as will be clear to the person skilled in the art.

The station 10 comprises a working surface 11 intended to accommodate, i.e. preferably support resting thereon, a temporary molding support 12 with a basic mix layer 28 on it for formation of a slab. The working surface may also form part of a suitable belt conveyor system or conveyor bench.

The temporary support may be in the form of a mold realized as a tray-like container with closed side walls for ensuring complete—including lateral—containment of the mix, or also a suitable tray or support sheet (especially if the mix is sufficiently cohesive to maintain its form when resting on a surface).

Means for shaping the edges of the mix may also be provided. These means are for example visible in FIGS. 2 and 4 in the form of suitable thrusters 13, 14, 15, 16 which act on the four side edges of the mix so as to shape the edge of the mix with a pyramidal profile. In the case of a flexible support for the mix, the thrusters may also operate so as to fold the edges of the support and also provide a further function of lateral containment of the mix inside the support as well as a shaping function.

The mix may be of any known type suitable for producing the particular type of product. For example, the basic mix may comprise a stone and/or stone-like and/or ceramic material and a binder as well as any additives. Generally the binder may of an inorganic nature, such a cement or a silicate, or of an organic nature such as a synthetic resin able to be hardened by the action of heat and/or a catalyst or a latex which can be solidified by means of drying.

The station 10 also comprises at least one dye dispensing device 17 which is intended to emit dyes towards the working surface 11 so that they are deposited within the basic mix layer arranged on the working surface.

The device 17 is supported by motorized movement means 18 for relative movement of said device above the working surface along several working axes, for example along at least two Cartesian axes parallel to the working surface, so as to position the device spatially, as will be clarified below.

In this way, the device 17 may follow any suitable trajectory above the said surface under the control of the electronic control system 19 (known per se, for example formed by a suitable programmed microprocessor unit) connected to the movement means 18.

In the embodiment shown in FIG. 1 the dispensing devices and the associated movement are advantageously two in number.

The movement means comprise preferably an anthropomorphic arm robot 18, known per se, with the dispensing devices mounted on the wrist. As a result it is also advantageously possible to have a controlled axis for inclination of the dispensing device relative to the perpendicular of the working surface. The robots are preferably positioned on opposite sides of the working surface (and the theoretical arrival path of the supports with the mix in slab form) and facing each other.

A single arm would also be feasible, even though this would result in doubling of the time needed for creation of the colored effects.

Figure 2:
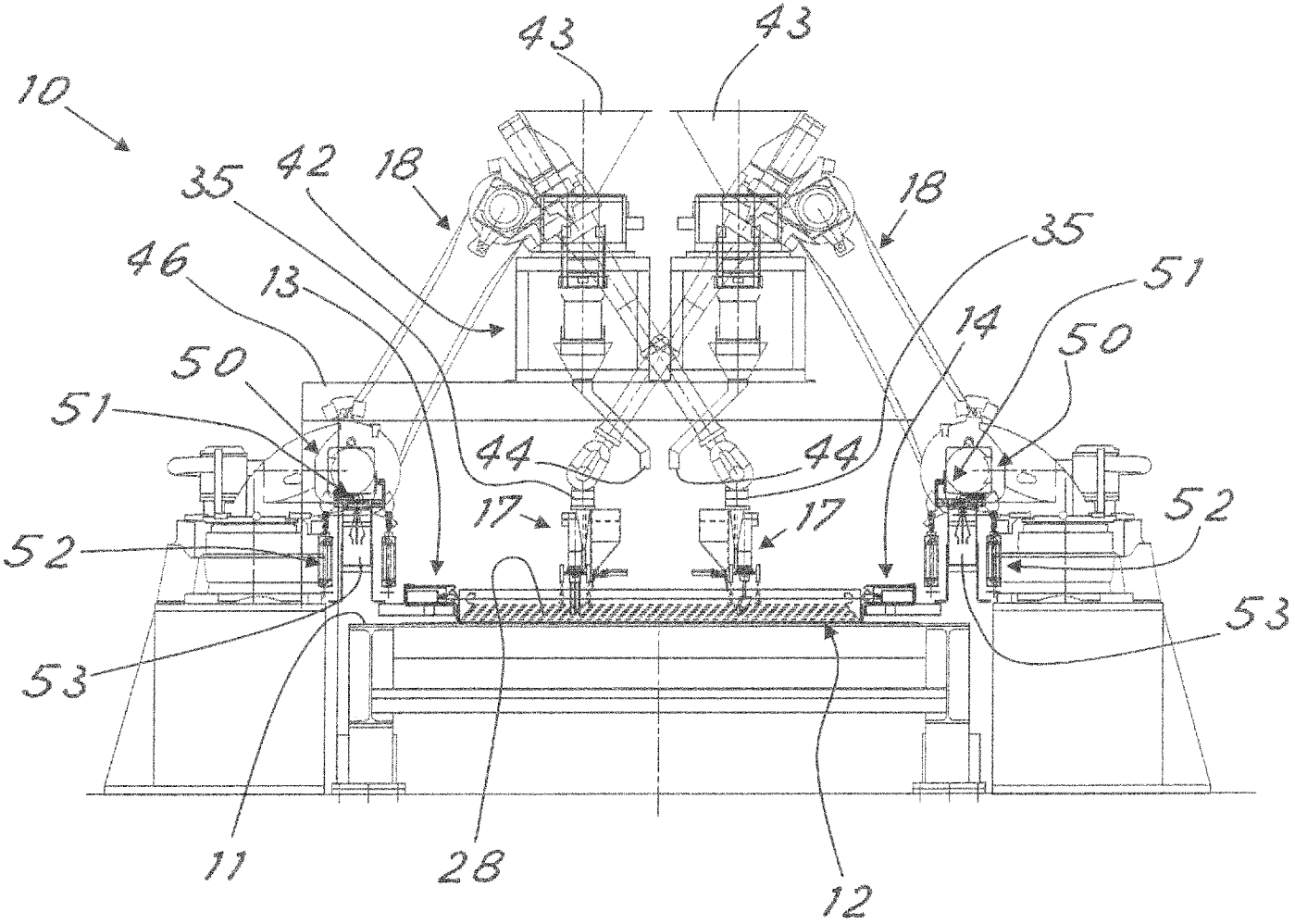
FIG. 2 shows a schematic side view of the station according to FIG. 1 in a first operating condition.
Figure 3:
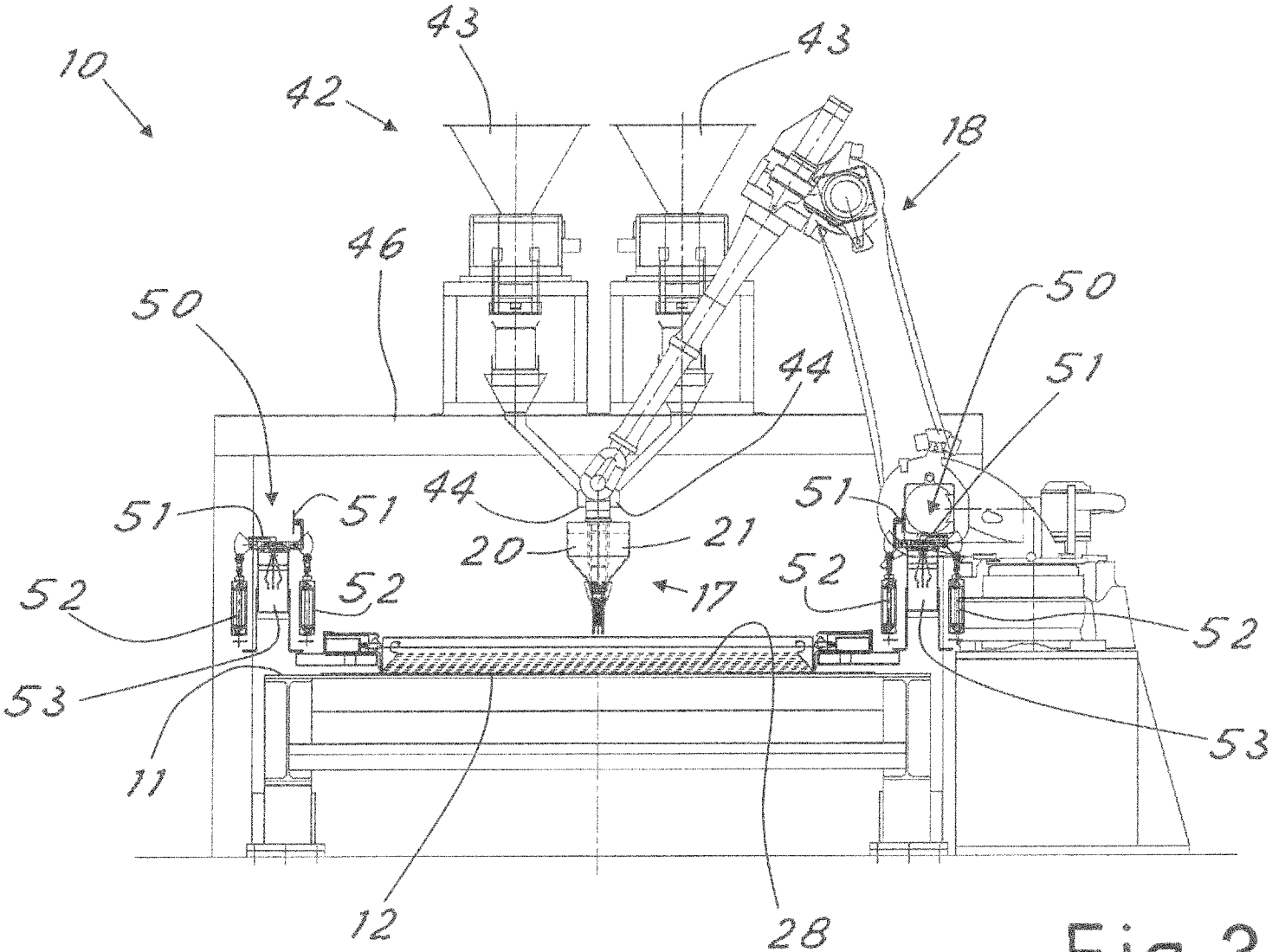
FIG. 3 shows a schematic side view, similar to that of FIG. 2, but with the station in a second operating condition.
Figure 4:
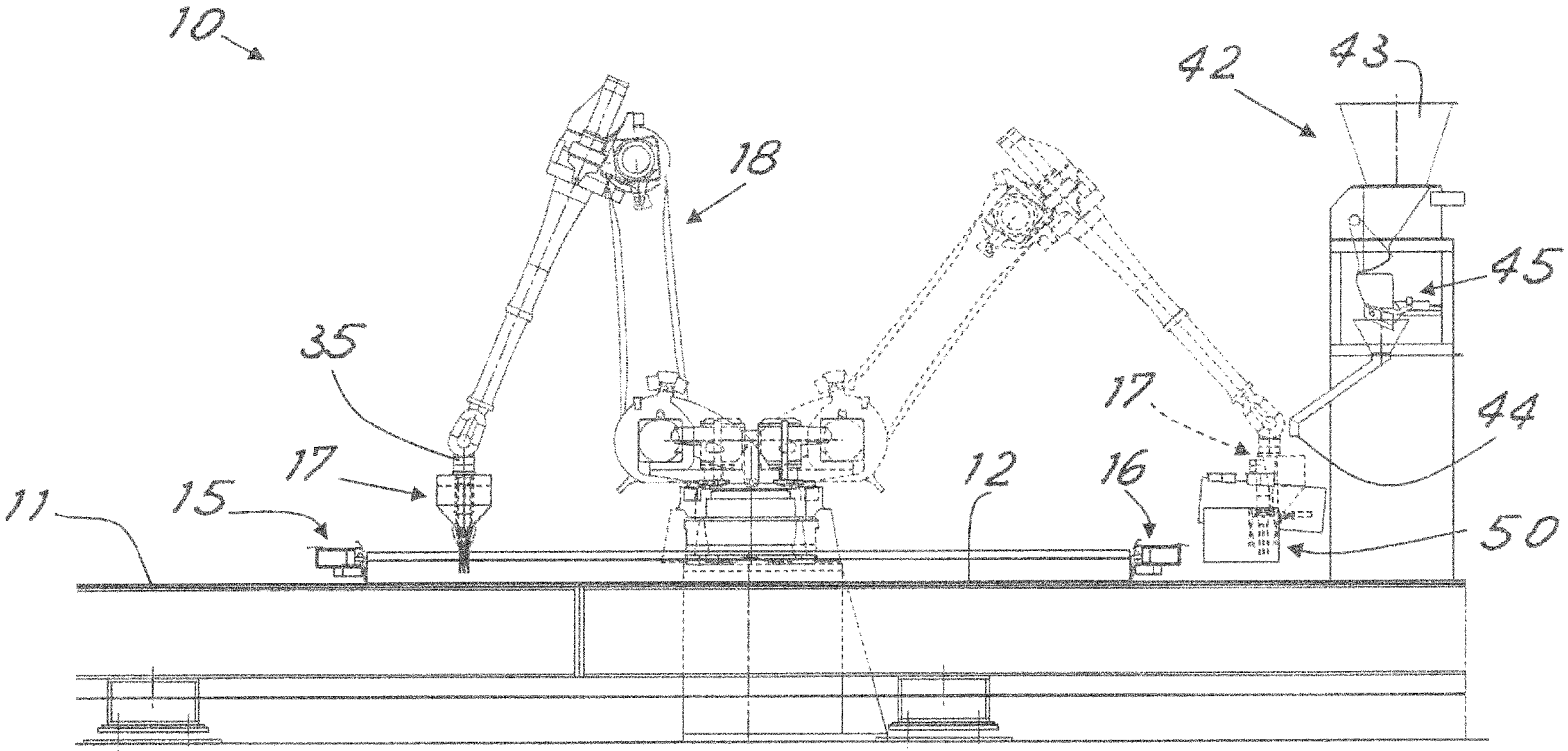
FIG. 4 shows a schematic longitudinal view of the station according to FIG. 1.

As can be seen more clearly in FIGS. 2, 3 and 4 and, in the form of an enlarged detail, for example in FIGS. 5-10, the dye dispensing device 15 comprises advantageously means for discharging powder dyes. Preferably, the powder discharging means are discharge hoppers and, in particular, are two hoppers arranged alongside each other, indicated by 20 and 21. Advantageously, the corresponding spouts or nozzles 22, 23 for controlled discharging of the powders are positioned underneath close together towards the center of the device. Deflectors may be advantageously provided so that the two spouts performing discharging substantially at the same point on the underlying working surface.

Each discharge spout has a cross-section which can be regulated by means of an associated closing valve (controlled by a corresponding actuator 24 or 25) which if need be opens so as to allow the powder dye to pass through.

Differently colored powder dye is preferably poured into each hopper.

The dispensing device 17 comprises advantageously (alternatively, or preferably in addition) nozzles for spraying liquid dye towards the working surface. Preferably nozzles are provided both on the front and on the rear of the device in order to increase the color effects which can be obtained. The Figures show advantageously two front nozzles 26 and two rear nozzles 27. Preferably, the nozzles of each pair are inclined towards each other so as to spray approximately a same point of the working surface and, for the reasons which will become clear below, the positioning point of the front nozzles and that of the rear nozzles lie along a longitudinal line of the device, as can be seen for example in FIG. 7, namely along a direction which is preferably the same as that of movement of the device along the trajectories to be colored.

The coloring agents or pigments used may be in both pulverulent, i.e. powder form and in liquid form.

The station 10 also comprises a tool, suitably directed towards the working surface and intended to interact mechanically with the mix on the underlying working surface, again under the control of the motorized movement means 18. The tool may be of various types. In particular, the tool is advantageously mounted on the dye feeder device so as to move with it.

As can be noted from the figures, the liquid dye spraying nozzles are preferably arranged both in front of and behind the tool relative to the direction of feeding of the tool. The nozzles are also advantageously arranged so as to perform spraying onto the mix along the trajectory travelled by the tool.

Figure 5:
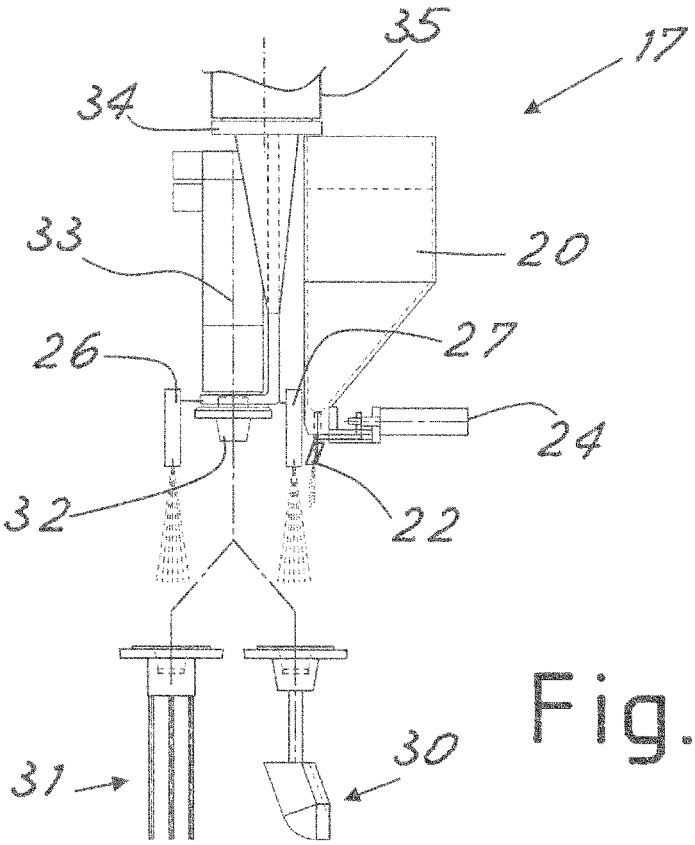
FIG. 5 shows a schematic, partially exploded, side view of a dye dispensing device of a station according to the invention.
Figure 6:
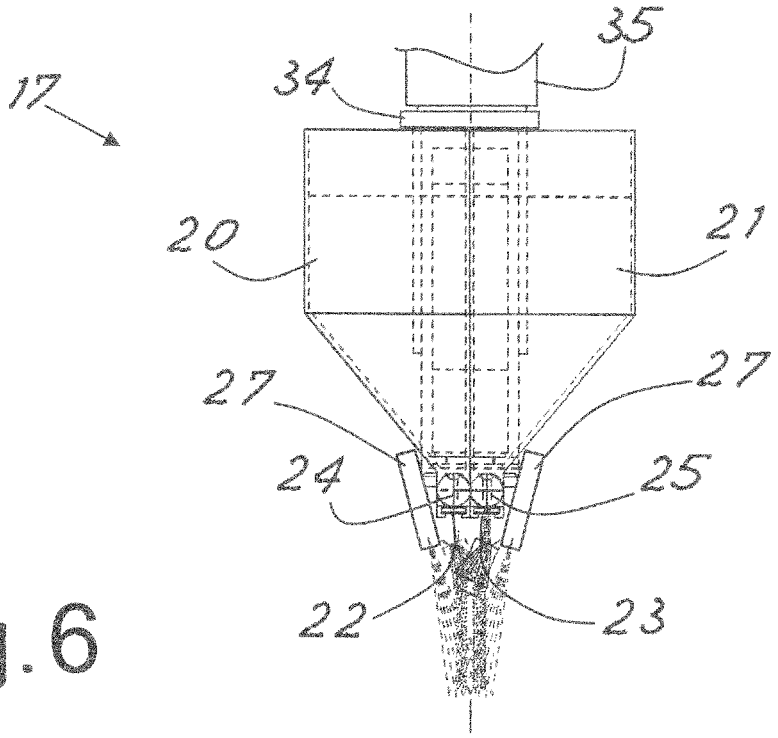
FIG. 6 shows a schematic front view of the device according to FIG. 5.

As can be clearly seen in FIG. 5, the tool may be advantageously chosen from two types of tool, namely a V-blade or grooving tool 39 and a mixer tool 31. The mixer tool is intended to form in the mix grooves extending in the direction of movement of the dispensing device on the working surface. These grooves are intended to receive at least some of the dyes emitted by the dispensing device.

The mixer tool 31 is instead intended to apply an action for local mechanical mixing of the mix, for the purposes which will be clarified below.

Advantageously, the two types of tool can be engaged alternately on a controlled engagement support or seat 32, known per se, of the dispensing device 17. The support may be advantageously motorized so as to rotate upon command about a preferably vertical axis 33. This allows for example the mixer tool 31 to rotate about the axis and perform its mechanical mixing action.

The support 32 may be advantageously a rotating spindle chuck able to engage automatically with a machining tool or instrument.

Figure 7:
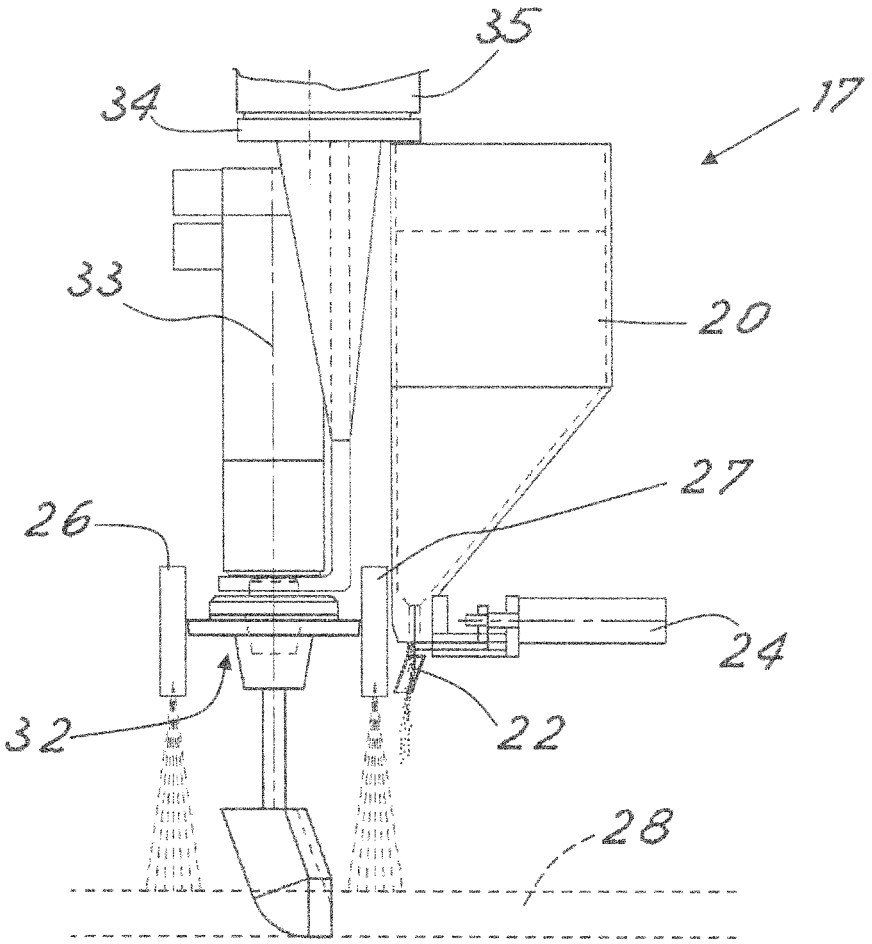
FIG. 7 shows a schematic side view of the device according to FIG. 5 with a first tool mounted.
Figure 8:
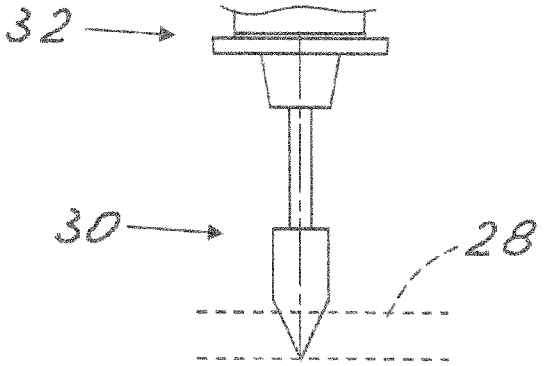
FIG. 8 shows a schematic front view of the tool according to FIG. 7.
Figure 9:
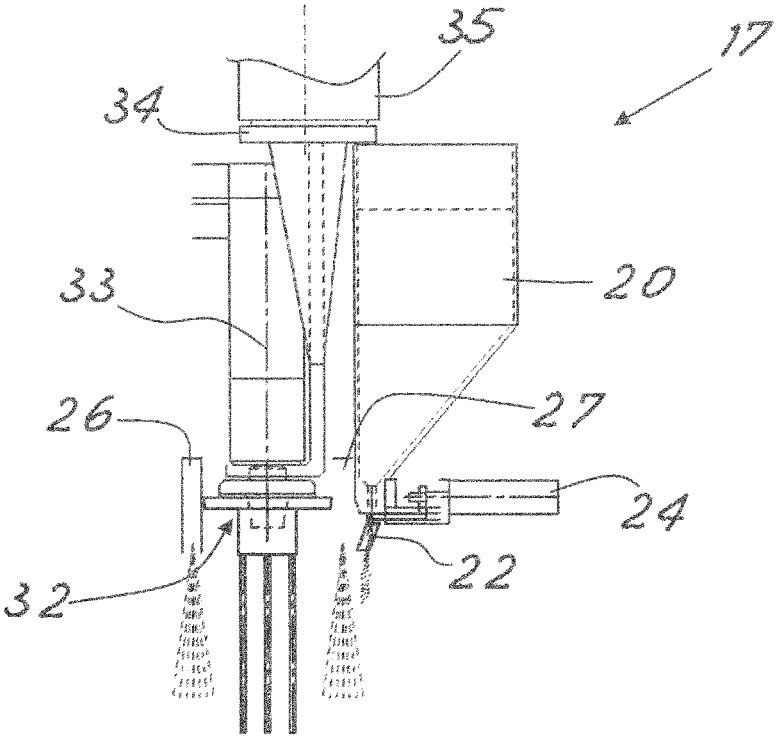
FIGS. 9 and 10 show schematic views similar to the views of FIGS. 5 and 6, but with a second tool mounted.
Figure 10:
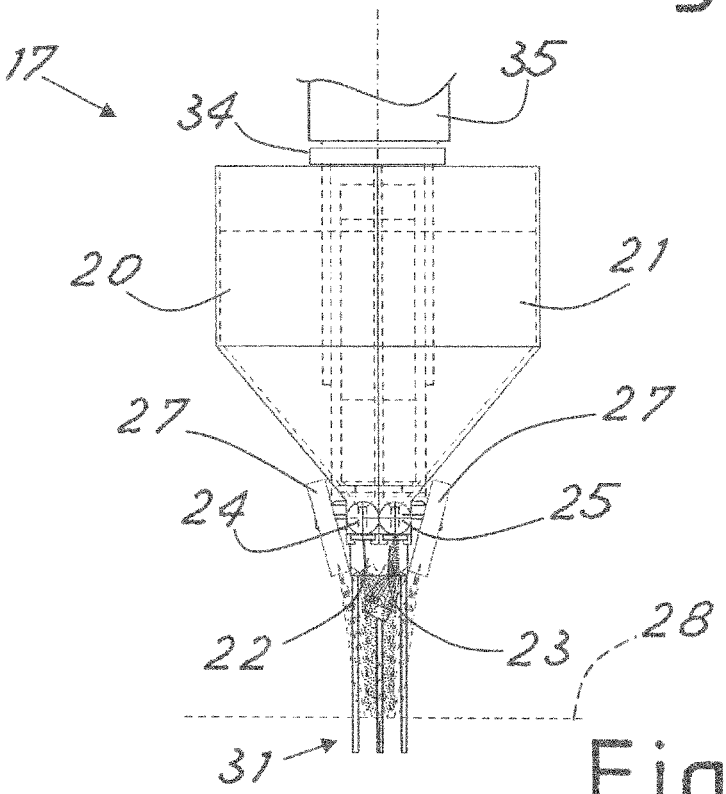

The V-blade or grooving tool 30, which is suitably shaped and pointed so as to form grooves with the desired shape (as visible for example from the two mutually perpendicular directions shown in FIGS. 7 and 9) will have the cutting edge kept constantly directed in the feeding direction of the device (to the right in FIG. 7). If the chuck is present, this chuck may remain preferably immobile and not rotate on the dispensing device when the tool 30 is used, while the dispensing device as a whole is moved by means of the movement means 18 and rotated so as to keep the orientation of its axis (which coincides with the direction of action of the tool 30) substantially directed along the trajectory of movement of the dispensing device on the surface, so as to form the groove with the tool 30 and allow the introduction of the dyes inside this groove. In particular, the device 17 is fixed with its support 34 on vertical-axis controlled rotation means 35 of the movement means so as to be able to orient the cutting edge in the direction of movement along the trajectories.

The tool 30 has the task of tracing a groove which may extend also within the entire thickness of the mix and be a few millimeters wide. This groove allows the dye which is subsequently poured (in the case of a powder dye) or sprayed (in the case of a liquid dye) to penetrate deep inside the mix.

In this way thin veins are for example formed throughout the thickness of the finished slab.

If a V-blade tool 30 is used, preferably the V-blade traces a groove in the mix and behind, along the groove traced in the mix, the liquid dyes are sprayed or the powder dyes are poured, whereby said dyes may be of the same color or preferably of a different color and penetrate into the depth.

The mixer tool 31 will be instead preferably in the form of a whisk or a blade, as in a food mixer, and comprises for example several vertical rods (for example four rods arranged at the vertices of a square) so as to rotate on itself about the vertical axis 33 owing to the rotating support or chuck 32. This tool has the task of mixing up locally the mix throughout most of its thickness and therefore of creating zones or areas with a different color or shade, producing a slab with a so-called stained effect.

The wrist of the anthropomorphic arms may also be able to perform inclination of the rotating chuck so that it may operate with its axis vertical, or horizontal or in any way inclined, depending on the shape of the mixing tool and its desired direction of action on the mix layer situated on the working surface.

When the mixer tool is used, the liquid dyes are preferably sprayed beforehand on the surface of the mix, following which the tool mixes up the dye with the mix, and finally other liquid dyes which may either have the same color or preferably a different color are sprayed onto the stirred mix. For this reason, the relative positioning of nozzles in front of and behind the tool, so as to be able to carry out the entire process in one pass, is advantageous.

In this way it is possible to obtain an area or zone with different colors or shades having a very attractive decorative effect both on the surface and also within the mass of the slab.

Advantageously, as can be clearly seen for example in FIG. 1, the station 10 also comprises a plurality 40 of tanks of liquid dye which are connected, via suitable known power supply means, if necessary under pressure, to the spraying nozzles in the devices 17 via corresponding pipes 41.

Preferably each nozzle may be supplied by a tank containing a different color.

The station 10 also preferably comprises a zone, indicated generally by 42, for replenishing the discharge hoppers 20,21, where there are storage containers or hoppers 43 which may fill the discharge hoppers 20, 21 which are moved by the movement means 18 underneath dispensing spouts 44 of said storage hoppers 43.

In this way, when one of the hoppers 20,21 of the dispensing devices 17 is nearly empty and therefore the powder dye has nearly been used up (condition detected for example by special known sensors in the dispensing device connected to the electronic control system 19), the corresponding dispending device is positioned by the control system underneath the dispensing spout 44 of a corresponding storage hopper which is operated by means of a discharging actuator 45 (shown for example in FIG. 4) so as to pour the required powder dye inside the small discharge hopper. Such a condition is schematically shown in FIG. 3 and (in broken lines) also in FIG. 4.

Owing to the replenishing system provided by the storage hoppers 43 (which may be large in size and also supplied by known top-up systems), the station may have a very long autonomy.

As can be clearly seen in FIGS. 1, 2 and 3, preferably the storage hoppers 43 are arranged above a crossbeam 46 arranged along one side of the working surface which is arranged upstream or downstream of said working surface relative to the movement of the system for transporting the slabs being machined. In other words, the crossbeam 46 may be along one side of the surface which is transverse to the movement of the slabs.

As can be clearly seen in FIG. 3, the crossbeam 46 is moreover situated sufficiently raised above the surface to allow any movement of the mix conveyor system below the storage hoppers 43 into and out of the station 10, without interference between the mix layer and said hoppers.

Advantageously, as can be clearly seen in FIGS. 1, 2 and 3, the station 10 may also be provided with tool-holder stores 50 (for example one for each dispensing device) positioned preferably along the two (preferably longitudinal) sides of the station.

Each store may have multiple stations for rotating and grooving tools of varying shape and size. The movement system may move so as to pick up from the store a selected tool by means of suitable pick-up means and then use it for the mechanical action in the desired mix zones. Advantageously, in the case of a tool mounted directly on the dye dispensing device, the pick-up means comprise the controlled engagement seat 32 present on the two dispensing devices 17. In this way, the movement means 18 may move the dispensing devices as far as the stores 50 so as to be able to replace automatically the tools in the dispensing devices 17, owing to the controlled engagement seat 32 present in the dispensing devices 17 (see FIG. 5) and suitably designed for this purpose in a known manner.

Advantageously, as can be noted for example from FIGS. 2 and 3, each store 50 may be provided with a hinged lid 51 for protecting the tools contained therein, which may be operated by a special actuator 52 for automatic opening and closing thereof.

When it is required to mount a tool or replace it in the dispensing device 17, the dispensing device moves towards the tool-holder store 50 which is opened so that the robotic arm may put back inside the store any tool mounted in the seat or chuck 32 of the dispensing device 17 and engage another one. Once the robotic arm has moved the dispensing device 17 towards the normal working zone, the lid 51 may be closed and the store thus returns into the rest condition.

Preferably the store 50 may comprise a tank 53 of cleaning liquid (for example a suitable solvent or detergent) for the dyes used, inside which the tools of the plurality of tools contained in the store are immersed in the rest position with at least one of their operating ends. In this way the deposited tools remain immersed and may thus be automatically cleaned.

For better cleaning it is also possible to rotate slowly the pick-up means or chuck or seat 32 of the dispensing device 17 before release and/or after engagement of a tool while the latter is immersed in the liquid.

Figure 11:
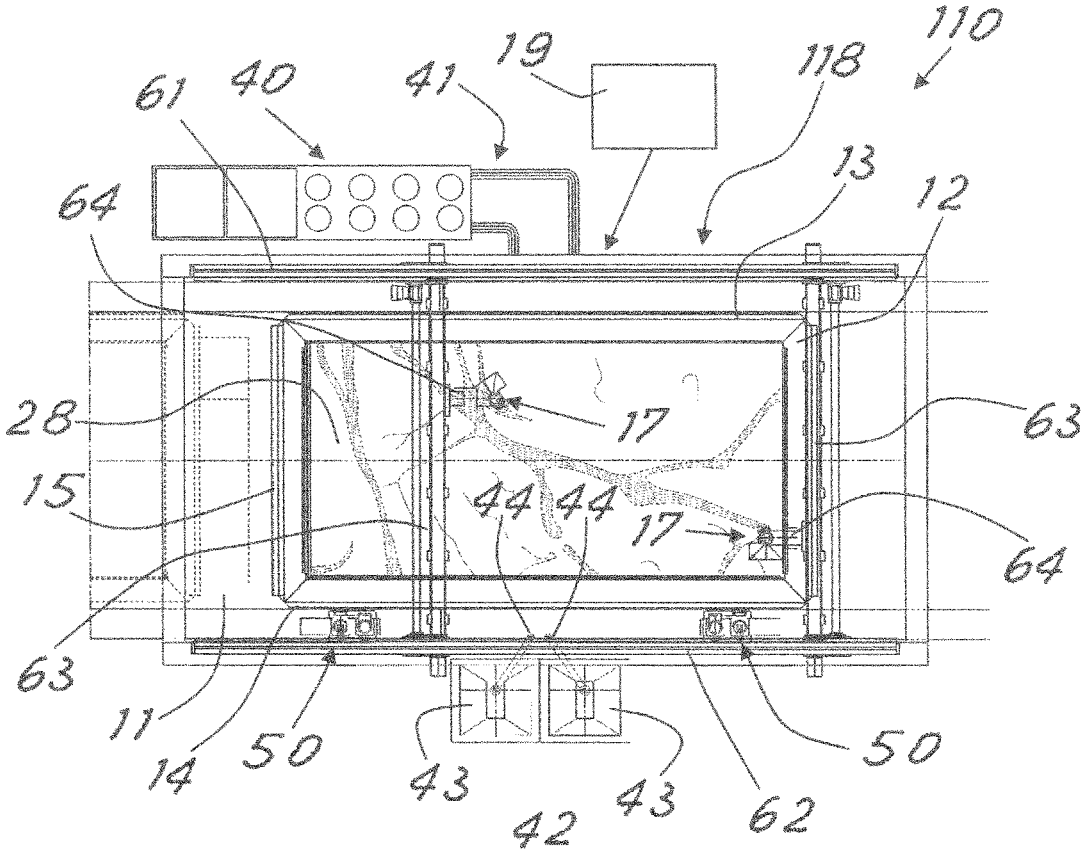
FIG. 11 shows a schematic view from above of a second embodiment of a station according to the principles of the invention.
Figure 12:
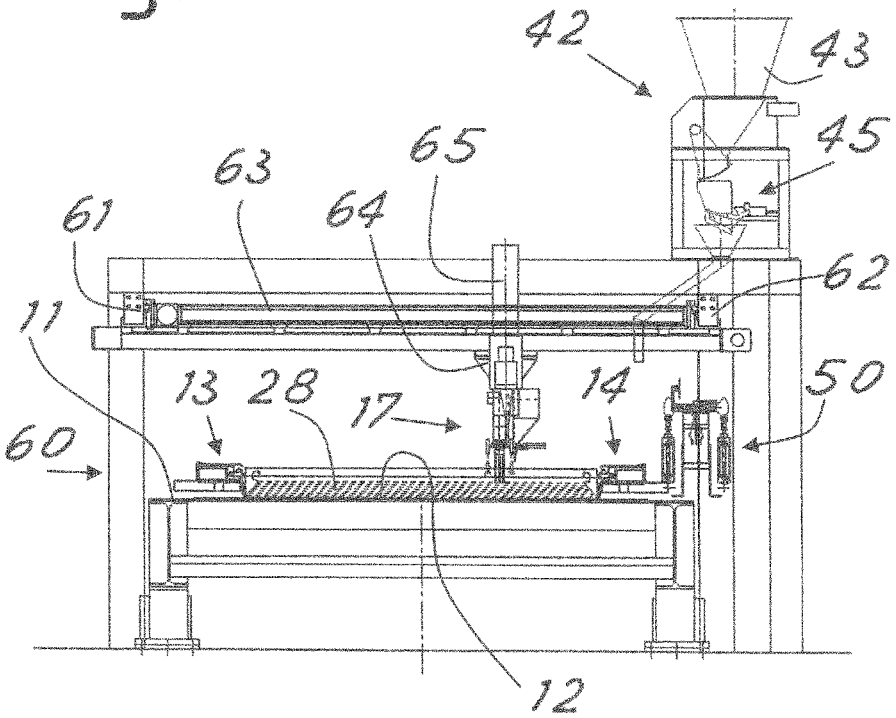
FIG. 12 shows a schematic cross-sectional view of the station according to FIG. 11.
Figure 13:
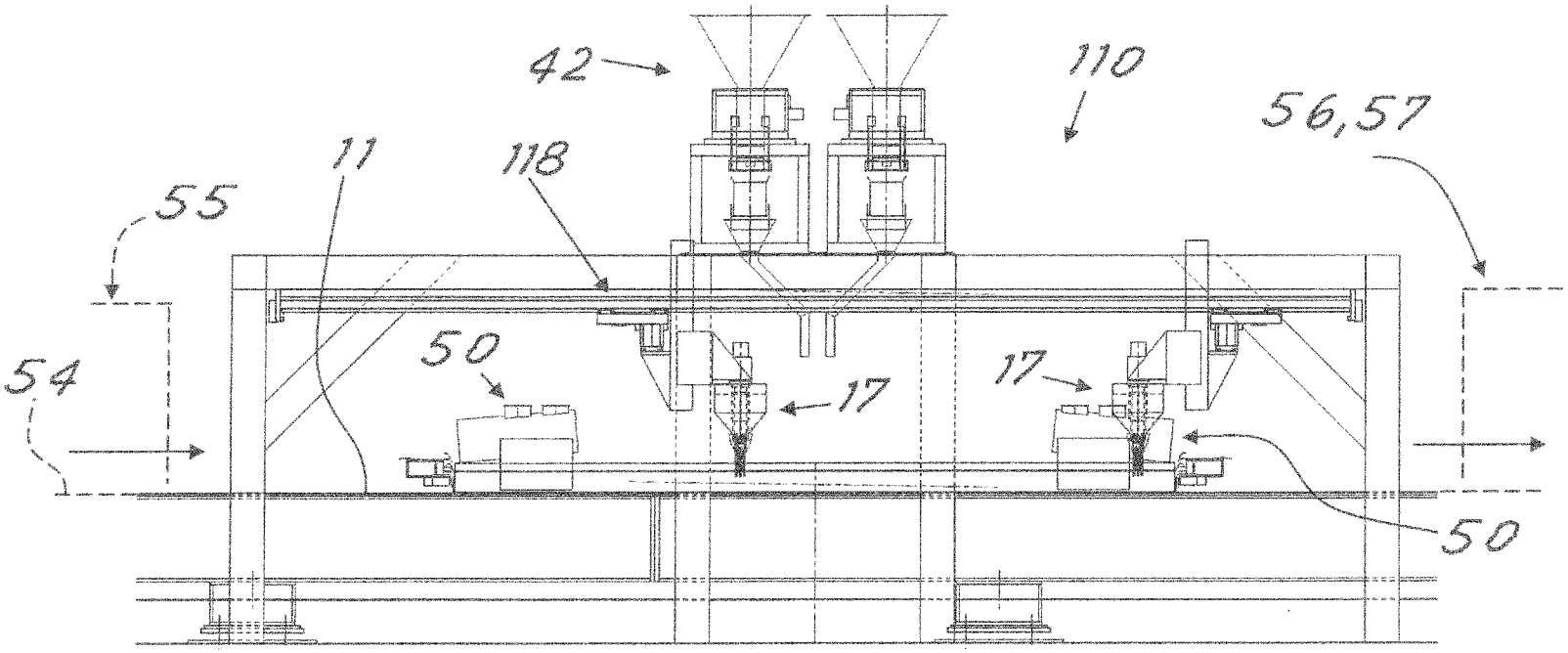
FIG. 13 shows a lateral and partial schematic view of a plant according to the invention with the station according to FIG. 11.

FIGS. 11, 12 and 13 show a possible constructional variant of a station according to the invention. This variation of embodiment, denoted generally by 110, comprises elements substantially similar to those described for the preceding embodiment (and therefore indicated by the same numbering and not further described, since reference may be made to the preceding description) and different means for moving the dispensing devices.

In particular, these different means comprise at least one Cartesian robot, denoted generally by 118. This Cartesian robot comprises in turn preferably a frame 60 (formed for example by pairs of uprights on opposite sides of the working surface) supporting two longitudinal travelways 61, 62 arranged parallel on opposite longitudinal sides of the working surface 11.

A crossbeam or cross-rail 63, on which in turn a dispensing device 17 of the type already described above travels, is operated so as to slide along the two longitudinal travelways 61, 62. Advantageously, the crossbeams or cross-rails 63 are two in number, each supporting an associated dispensing device 17.

The two beams 63 therefore each form a gantry structure which is mounted spanning the working surface and may be displaced in the longitudinal direction above the mold or tray filled with mix.

As in the case of the anthropomorphic arm robot, the programmable electronic control system 19 controls the movement of the Cartesian robot or robots 118 so as to move the devices 17 in an interpolated manner along the desired trajectories. The devices 17 are mounted on a motorized carriage 64 which travels along the beam 63 and are advantageously rotatable controllably about the perpendicular to the working surface so as to be able to be oriented with respect to the trajectories to be followed on the surface. The devices 17 are also vertically displaceable along a motorized axis 65 of the Cartesian robot so as to be able to be raised or move in a controlled manner towards the working surface.

Compared to the preceding solution, the storage hoppers 43 containing the powder dye are preferably positioned differently and, in particular, are positioned laterally and in a central position along one longitudinal side of the working surface 11 parallel to the travelways 61, 62. This allows easy filling of the hoppers 44 of the dispending devices 17 and reduces the possibility of interference between the two movable beams 63.

Moreover, the two tool-holder stores 50 may be positioned differently compared to the preceding solution. In particular, they may be positioned on the same longitudinal side and at the two opposite ends of the working surface (in a position which can be reached by the Cartesian movement system), again so as to reduce the possibility of interference between the two movable beams 63.

The tanks 40 for the liquid dye may instead be positioned in the same manner as in the preceding solution.

It is evident that the anthropomorphic robot arms 18 of the first embodiment allow a greater freedom of movement so that it is possible to arrange the storage hoppers 43 for the powder dye and the tool-holder stores 50 where it is most convenient or preferred, while with the Cartesian-axis system according to the second embodiment the positioning of these elements is more limited. This disadvantage may be offset by a lower cost of the Cartesian movement system compared to anthropomorphic arm robots.

In both cases it can imagined by the person skilled in the art that the electronic control system 39 may have a functional logic which avoids collision between the robot arms or the Cartesian beams.

With both types of automated movement, the control system may receive or calculate desired trajectories for the coloring effect pattern on the slabs and, once a temporary support with a basic mix layer for formation of the slab has been received on the working surface, it follows coloring trajectories with the dispensing device which emits dyes towards the working surface so as to deposit them within the basic mix layer. The tool mounted on the device may perform the machining operations with grooving and/or mixing as already described above.

Once the coloring effects have been traced, the mix layer is advantageously conveyed to the next compaction or vibrocompression step and then to the hardening step in a special hardening station of the plant, the station for realization of coloring effects forming part thereof.

As schematically shown in FIG. 13, the production plant applying the principles of the invention may obviously comprise a conveying line 54, for example of the conveyor belt type (which may include the same working surface of the station 10 or 110) along which the following stations known per se are arranged sequentially: stations 55 for forming the basic mix layer on temporary supports (or casting station), stations for the realization of coloring effects 10, 110 (the figure shows by way of example a station 110), known series of stations 56 for vibrocompression or vibrocompaction of the mix provided with the coloring effects (also depending on the type of slabs to be produced), which may comprise or be followed by known stations 57 for hardening the mix with the applied coloring effects.

For example, for a production line using Bretonstone technology, downstream of the stations 10 or 110 there will be a vibrocompression station: for production lines using Bretonterastone technology, downstream there will be a vibrocompaction station.

The mix vibrocompression step may be advantageously performed under a vacuum. During this step, the mix is subject for a given time period to a vacuum of given value inside a special press, while a vibratory motion at a predetermined frequency is applied to the press.

The rough slab thus obtained is then subjected to a hardening step which depends on the type of binder used.

At this point it is clear how the predefined objects have been achieved.

The station for producing the coloring effects is controlled and managed by the control system which, following a pattern or decorative effect to be realized in the finished slab and hence veining, areas with different shading or the like, decides both the path which each device must follow and the various changes of tools and/or dye.

By optimizing the various programmed paths and the changes to be carried out (tool changes and dye changes) and in particular by reducing the movement of the dispensing devices and the number of changes to be made, it is possible to reduce the dye dispensing time and therefore the slab production time.

As a result of the principles of the invention it is possible to obtain slabs with coloring effects within the mass in a rapid and efficient manner, also in the case of slabs with large dimensions (for example including a side length of a few meters). In particular, it is possible to use several dyes and tools in an efficient manner so as to be able to switch from one dye to another and from one tool to another simply and rapidly at any point on the slabs or among different slabs.

With the station according to the invention it is also possible to produce a slab with any colored decorative effect by designing the effect, and the station then, suitably programmed, is able to produce the veining and coloring in very precise zones so as to obtain the desired slab.

In particular, owing to the particular dispensing device, it is possible to produce slabs with any type of veining or effect and any dye, by simply filling the containers or the loading hoppers with the desired dye and suitable programming the movements of the station. Changing the color is simple and rapid and may be performed on different slabs or even on the same slab. It is therefore possible to produce easily slabs with veining, color effects or areas with different shades and colors on the same slab.

With the station according to the invention it is easy to obtain slabs with veining or a color effect practically throughout the thickness of the slab, since the dye is poured directly into a groove formed in the mix or is mixed up by means of a special tool. It has also been found that, with the deposition system according to the invention, by means of a subsequent vibrocompaction or vibrocompression step it is possible to obtain easily even deeper penetration of the coloring such that it affects the entire thickness of the mix, without altering in an uncontrollable manner the desired pattern.

On the other hand it is also possible to obtain slabs with a "stained" effect having bigger or smaller zones or areas with specific shades.

Owing to the deposition precision which can be achieved with a station according to the invention it is possible to obtain a repetition of the same effect on several slabs so that all the slabs have exactly the same veining or color effects and therefore are practically identical to each other, or create a so-called mirror effect where two slabs have on the surface veining effects which are a mirror-image of each other, resembling for example the two cut faces of a same natural stone with veining. Slabs with a mirror-image design may for example be laid next to each other so as to produce an "open stain" effect typical of natural marbles obtained from the sawing of blocks.

The flexibility of a station, a plant and a production method according to the invention is therefore considerable since slabs with varying decorative characteristics may be obtained and, in particular, slabs which all have the same decorative characteristics or slabs which each have different decorative characteristics may be obtained.

Obviously the description above of an embodiment applying the innovative principles of the present invention is provided by way of example of these innovative principles and must therefore not be regarded as limiting the scope of the rights claimed herein. For example, the movement means may be other suitable known types, different from those shown, provided that they have the desired precision and freedom of positioning in relation to the mix layer to be colored. Moreover, the dispensing devices may consist of a different number (for example only one or more than two) with a corresponding number of movement means.

In particular, in the case of robotized arms, a single arm or more than two arms may be provided, even though the use of two arms ensures a limited machining time, keeping at an acceptable level the manufacturing costs and the operational complexity needed to prevent the risk of collision between the arms, which would otherwise increase if there were more than two arms.

Similarly in the case of the station with Cartesian-axis movement means it is possible to envisage also a single beam or three or more beams each of which provided with a dispensing device.

Also the tools may be different from those shown in the figures.

Although the movement means may also only provide a movement of the dye dispensers in a plane parallel to the surface of the mix, it has been found to be advantageous if they can also provide a further movement towards or away from the plane. As well as making it easier to reach the storage hoppers and/or the tool-holder stores, this further movement may be used to vary the distance of the dye dispensing device from the mix during the action of the tool and/or dispensing of dyes. In other words, the trajectories followed by the dispensing devices during machining may advantageously also be trajectories in three-dimensional space and not only in one plane, with variations in the height of the dispensing devices above the mix. This may allow for example dynamic variation of the degree of diffusion of the dye and/or the breadth and depth of the grooves and/or the mixing action which are produced by the tool mounted on the device. Moreover, the movement means may comprise a separate movement for tool and dye dispenser.

The invention claimed is:

1. A station for a realization of coloring effects in a mix for a production of slabs, comprising:

a working surface to accommodate a temporary support with a basic mix layer for the formation of a slab;

at least one dye dispensing device for emitting dyes toward the working surface so as to deposit the dyes on the basic mix layer on the temporary support;

a movement means for a relative movement of the dye dispensing device above the working surface;

a control system connected to the movement means for controlling the displacement of the dye dispensing device on the working surface so as to follow trajectories along which the dyes are emitted toward towards the basic mix layer;

at least one tool movable with the movement means to interact mechanically with areas of the basic mix layer for receipt of the dyes emitted by the dye dispensing device to achieve coloring effects in the basic mix layer; and at least one store for a plurality of tools and a means for controlled pick-up of a selected tool from the at least one store.

2. The station according to claim 1, characterized in that the tool is supported on and movable with the dye dispensing device.

3. The station according to claim 1, characterized in that the dye dispensing device comprises discharge hoppers for discharging powder dyes.

4. The station according to claim 3, characterized in that the discharge hoppers are two in number.

5. The station according to claim 3, further comprising a zone for replenishing the discharge hoppers and in which there are storage hoppers for discharging on command into the discharge hoppers carried by the movement means under dispensing spouts of said storage hoppers.

6. The station according to claim 1, characterized in that the dye dispensing device comprises nozzles for spraying liquid dyes.

7. The station according to claim 1, characterized in that the tool is a grooving tool, intended to form grooves in the basic mix layer in a direction of movement relative to the dye dispensing device, wherein the grooves are defined for receiving the dyes emitted by the dye dispensing device.

8. The station according to claim 1, characterized in that the tool is a mixer tool mounted on a motorized rotating support.

9. The station according to claim 1, characterized in that the means for controlled pick-up comprise an engaging seat which is powered to rotate an engaged tool.

10. The station according to claim 1, characterized in that the at least one store comprises a tank of cleaning liquid in which tools of the plurality of tools are immersed by at least one operating end of each of the tools.

11. The station according to claim 1, characterized in that the movement means comprise an anthropomorphic robot arm.

12. The station according to claim 1, characterized in that the movement means comprise a Cartesian robot.

13. The station according to claim 1, characterized in that the movement means are two in number, each of the two movement means having one or more of a dye dispensing device and a tool.

14. A method for the realization of coloring effects on a slab by means of the station according to claim 1, comprising the steps of:

receiving on the working surface a temporary support with a basic mix layer for the formation of the slab;

by means of the control system, causing the dye dispensing device to follow trajectories so that the dye dispensing device deposits the dyes in the basic mix layer;

subjecting the basic mix layer to a mechanical action of the at least one tool in areas for receipt of the dyes; and conveying the basic mix layer for subsequent compaction and then for hardening.

15. The method according to claim 14, further comprising the steps of:

producing grooves in the basic mix layer by means of the at least one tool; and emitting the dyes from the dye dispensing device into said grooves.

16. The method according to claim 14, further comprising the step via the tool of mixing zones of the basic mix layer following receipt of the dyes from the dye dispensing device.

17. A plant for production of slabs, comprising a conveyor line including a plurality of sequentially-arranged stations, as follows:

a station for formation of a basic mix layer on a temporary support;

the station according to claim 1 for realization of coloring effects in the basic mix layer;

a station for one or more of vibrocompression and of vibrocompaction of the basic mix layer with the coloring effects; and a station for hardening of the basic mix layer with the coloring effects.

* * * * *